US008484892B2

(12) United States Patent
Giannis

(10) Patent No.: US 8,484,892 B2
(45) Date of Patent: Jul. 16, 2013

(54) ELECTRIC DOOR OPERATOR

(75) Inventor: Peter M. Giannis, Arlington Heights, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 13/455,218

(22) Filed: Apr. 25, 2012

(65) Prior Publication Data

US 2012/0291354 A1 Nov. 22, 2012

Related U.S. Application Data

(60) Provisional application No. 61/487,922, filed on May 19, 2011.

(51) Int. Cl.
*E05F 17/00* (2006.01)

(52) U.S. Cl.
USPC ..... 49/118; 49/116; 49/141; 49/139

(58) Field of Classification Search
USPC ..... 49/107–111, 116, 118, 122, 139–141; 74/425, 396, 397, 405; 188/171, 173
See application file for complete search history.

(56) References Cited

U.S. PATENT DOCUMENTS

| | | | | |
|---|---|---|---|---|
| 2,893,506 | A | 7/1959 | Daugirdas | |
| 3,844,062 | A * | 10/1974 | Daugirdas | 49/28 |
| 4,087,939 | A * | 5/1978 | Elguindy et al. | 49/118 |
| 4,375,140 | A * | 3/1983 | Blair et al. | 49/108 |
| 4,423,799 | A * | 1/1984 | Glaser et al. | 187/314 |
| 4,570,500 | A | 2/1986 | Richter | |
| 4,658,545 | A | 4/1987 | Ingham et al. | |
| 4,730,513 | A | 3/1988 | Heinrich et al. | |
| 5,332,279 | A | 7/1994 | Golemis et al. | |
| 5,893,236 | A | 4/1999 | Krbec et al. | |
| 6,125,768 | A * | 10/2000 | Kurnik | 105/343 |
| 6,167,781 | B1 | 1/2001 | Madsen et al. | |
| 6,189,832 | B1 | 2/2001 | Jackson | |
| 6,520,527 | B2 | 2/2003 | Laarman | |
| 6,662,501 | B2 * | 12/2003 | Pagowski et al. | 49/141 |
| 6,758,109 | B2 | 7/2004 | Nakakado | |
| 7,040,473 | B2 | 5/2006 | Schachtl et al. | |
| 7,066,318 | B2 | 6/2006 | Kato | |
| 7,254,918 | B2 * | 8/2007 | Fronz et al. | 49/122 |
| 7,946,079 | B2 * | 5/2011 | Brown | 49/139 |
| 8,291,644 | B2 * | 10/2012 | Plavnik et al. | 49/340 |
| 2006/0101718 | A1 * | 5/2006 | Fronz et al. | 49/141 |

(Continued)

FOREIGN PATENT DOCUMENTS

| | | |
|---|---|---|
| DE | 2320351 A1 | 10/1974 |
| DE | 2926824 A1 | 1/1981 |
| EP | 1072749 A2 | 1/2001 |

(Continued)

*Primary Examiner* — Katherine Mitchell
*Assistant Examiner* — Abe Massad
(74) *Attorney, Agent, or Firm* — The Webb Law Firm

(57) ABSTRACT

An electric door operator for opening and closing one or a spaced pair of transit vehicle passenger doors for being mounted over an opening for the doors. A rotatable input shaft has an electric motor secured to the input shaft for driving the input shaft, a worm centrally positioned on the motor shaft, and an electric brake mounted to the input shaft at an end opposite of the electric motor. A drum cam lifts a pinion from a worm gear disconnecting the worm gear from an output gear train in an emergency.

9 Claims, 3 Drawing Sheets

U.S. PATENT DOCUMENTS

| | | | | |
|---|---|---|---|---|
| 2008/0196312 | A1 | 8/2008 | Brown | |
| 2010/0012458 | A1 | 1/2010 | Giuliani et al. | |
| 2010/0170158 | A1* | 7/2010 | Plavnik et al. | 49/359 |
| 2010/0199564 | A1* | 8/2010 | Plavnik et al. | 49/280 |
| 2010/0319261 | A1 | 12/2010 | Beck et al. | |

FOREIGN PATENT DOCUMENTS

| | | | |
|---|---|---|---|
| GB | 1278041 | A | 6/1972 |
| JP | 200139276 | A | 2/2001 |
| JP | 2003113919 | A | 4/2003 |

* cited by examiner

ELECTRIC DOOR OPERATOR

BACKGROUND OF THE INVENTION

1. Field of the Invention

This invention relates to door operators for doors on transit vehicles such as buses and trains. Some vehicle doors have a single panel mounted at an outside edge of the door opening. Many vehicle doors have two panels, each mounted at an outside edge of the door opening. The panels usually swing outward to permit entrance or exit of passengers. Often, the doors are caused to open or close with a pneumatic cylinder or electric motor and a well known teeter assembly mounted over the top of the door opening. The space available for mounting the door operator over the door opening is often limited. Automatic opening and closing of the doors is controlled by the vehicle driver at stops for picking up and discharging passengers. It is an essential feature of door operators that the doors cannot be pushed open by passengers leaning against the doors, for example, while the vehicle is moving. However, in an emergency there must be a manual release that can be operated by a passenger. Generally, passengers must be able to operate the manual release with no more than 20 pounds pull force.

2. Description of Related Art

U.S. Pat. No. 5,332,279 entitled "Power Door Operator for Multi-Passenger Mass Transit Vehicles" discloses an electric door operator and illustrates the manner in which the spaced doors are rotated open and closed by the action of the teeter assembly connected to drive rods and pivot levers fixed to the vertical door shafts on which the doors are mounted. FIG. 1 of the '279 patent is incorporated herein by reference. This application is directed to an improved system for driving the teeter assembly with an electric motor.

SUMMARY OF THE INVENTION

An electric door operator for opening and closing one or a spaced pair of transit vehicle passenger doors comprises a structure for being mounted adjacent an opening for the doors. A rotatable input shaft is mounted to the structure with an electric motor secured to the input shaft for driving the input shaft, a first stage pinion positioned on the input shaft, and an electric brake mounted to the input shaft. An output shaft is rotatable relative to the structure and has a teeter mounted thereon with journal bearings at at least one end thereof for engagement with drive bars for opening and closing the doors. An output gear is fixed to the output shaft for driving the output shaft.

A first stage shaft is rotatable relative to the structure and has a first stage gear fixed to the shaft in a position to engage the first stage pinion on the input shaft. A second stage pinion with a sliding connection to the first stage gear shaft enables axial movement of the second stage pinion between engaged and disengaged positions with the first stage gear.

A second shaft is rotatable relative to the structure. A second stage gear is fixed to the second shaft and arranged for engagement with the second stage pinion. A third stage pinion is fixed to the second shaft for directly or indirectly transferring torque to the output gear fixed to the output shaft.

A drum cam shaft is rotatable relative to the structure. A drum cam is axially movable relative to the drum cam shaft. A pin extending from the drum cam shaft engages a cam slot in the drum cam. A lifting plate is fixed to the drum cam and extends to engage a slot in the first stage pinion to move the first stage pinion between engaged and disengaged positions.

A disengagement lever and an engagement/disengagement cam are fixed to the drum cam shaft. A pin extends from the disengagement lever.

A mechanical release is fixed to a slotted end piece. The aperture in the slotted end piece receives the pin extending from the disengagement lever. When the mechanical release is actuated, the drum cam shaft rotates the pin extending from the drum shaft and the drum cam moves to lift the lifting plate and first stage pinion to the disengaged position.

Briefly, according to a specific embodiment of this invention, there is provided an electric transit door operator for opening and closing a spaced pair of transit vehicle passenger doors. A housing is provided with a base plate for being mounted over an opening for the doors. A rotatable input shaft is mounted over the base plate and parallel thereto. An electric motor is secured to the input shaft for driving the input shaft; a worm is centrally positioned on the input shaft; and an electric brake is mounted to the input shaft at an end opposite the electric motor.

An output shaft is rotatable relative to the housing and has a teeter mounted thereon with journal bearings at opposite ends thereof for engagement with drive bars for opening and closing the doors. A gear is fixed to the output shaft for driving the output shaft.

The input shaft is rotatable perpendicular to the output shaft and has a worm fixed to the input shaft in a position to engage a worm gear. A second stage pinion with a sliding connection to the gear shaft enables axial movement of the second stage pinion between engaged and disengaged positions, A second shaft is rotatable parallel to the output shaft. A second stage gear is fixed to the second shaft and arranged for engagement with the second stage pinion. A third stage pinion is fixed to the second shaft. The third stage pinion directly or indirectly transfers torque to the output gear fixed to the output shaft.

A drum cam shaft is rotatable on a drum cam shaft parallel to the output shaft. The drum cam is rotatably and axially movable relative to the drum cam shaft. A pin extends from the drum cam shaft engaging a cam slot in the drum cam. A lifting plate is fixed to the drum cam and extends to engage a slot in the second stage pinion to move the second stage pinion between engaged and disengaged positions. A disengagement lever and a disengagement cam are fixed to the drum cam shaft.

A cable sheath bracket fixes the sheath of a release cable to the base plate. A release cable is fixed to a slotted end piece. The aperture in the slotted end piece receives the pin extending from the disengagement lever. A return spring urges the slotted end piece away from the cable sheath bracket. When the release cable is pulled, the drum cam shaft rotates the pin extending from the drum cam shaft and the drum cam moves to lift the lifting plate and second stage pinion to the disengaged position.

BRIEF DESCRIPTION OF THE DRAWINGS

Further features and other objects and advantages will become apparent from the following detailed description made with reference to the drawings in which.

DESCRIPTION OF THE PREFERRED EMBODIMENTS

Figure 1:
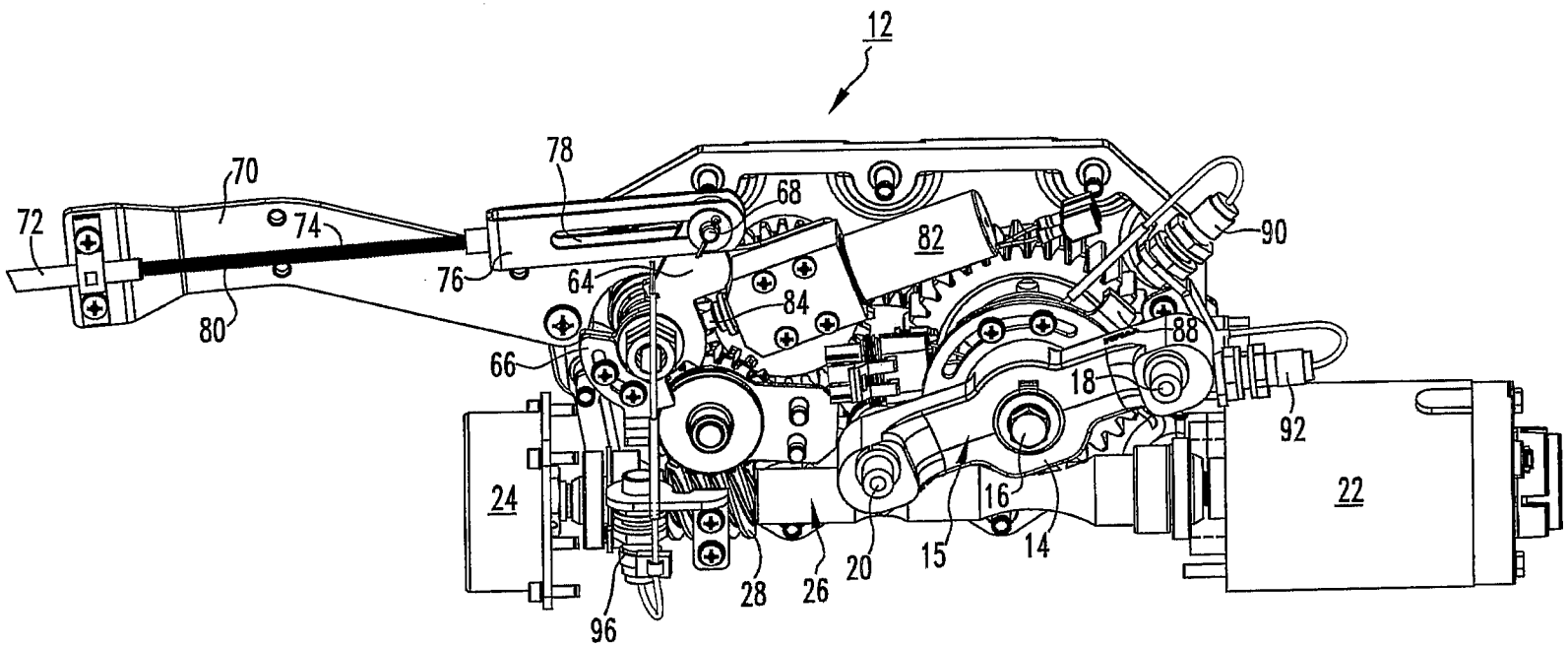
FIG. 1 is a front view in partial perspective of an electric door operator according to this invention.

Referring now to FIG. 1, a structure or housing 12 supports or encloses most of the moving elements of the door operator. A housing has a base portion to which the moving elements are indirectly or directly mounted. The teeter 14 is mounted on an output shaft 16. The teeter 14 has a drive arm 15 mounted to the output shaft 16 with journals 18, 20 at one or both ends for receiving drive rods (not shown). The teeter can rotate both clockwise and counterclockwise to operate the drive rods. Mounted on opposite sides of the housing 12 are electric motor 22 and electric brake 24 connected to each end of an input shaft 26. The electric motor can be controlled to rotate either clockwise or counterclockwise.

Figure 2:
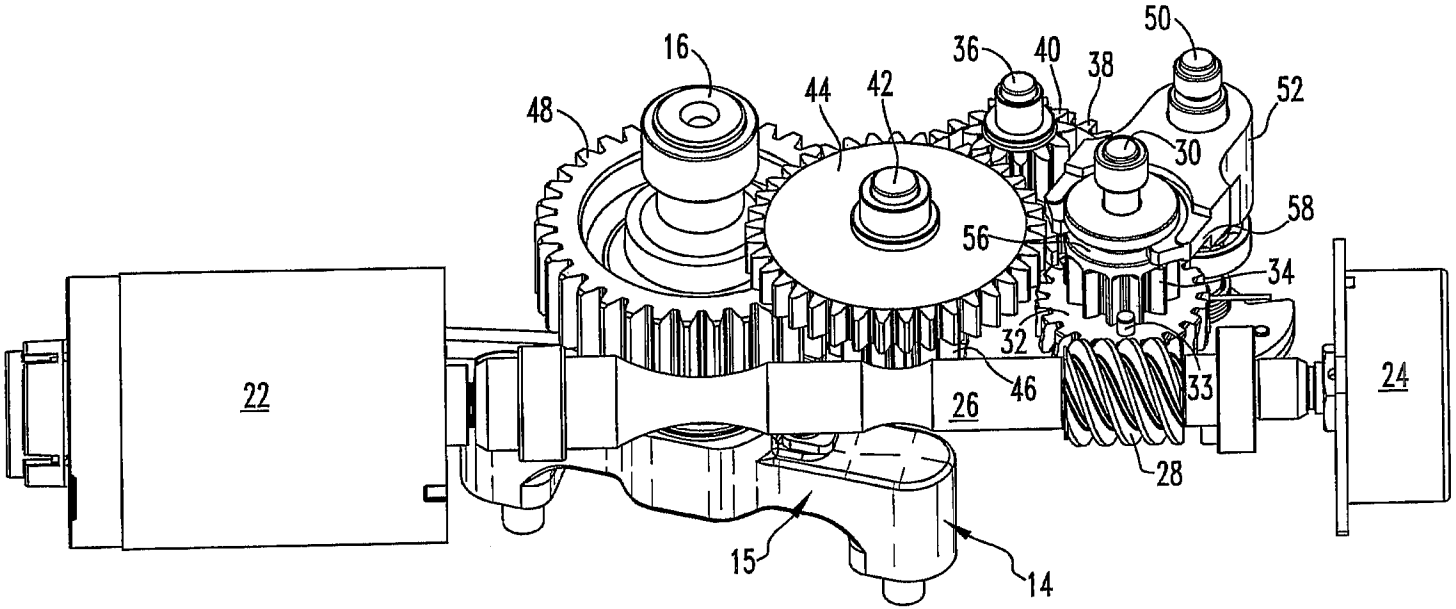
FIG. 2 is a side view in partial perspective of an electric door operator according to this invention in which the housing has been removed to better observe the moving parts.
Figure 3:
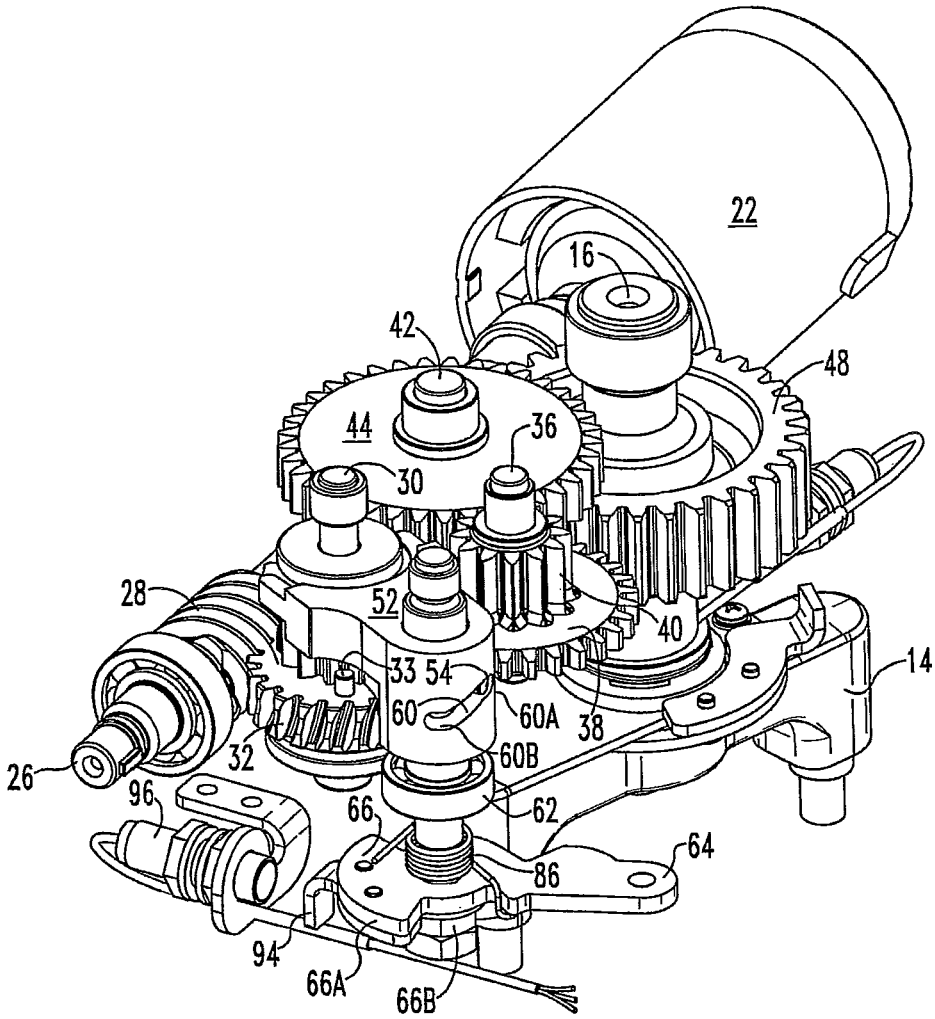
FIG. 3 is an end view in perspective of an electric door operator according to this invention with the housing and brake removed to better observe certain of the moving parts.

Referring now to FIGS. 2 and 3, the electric motor 22 is coupled to the input shaft 26 at one end and to the electric brake 24 mounted to the input shaft, for example, at the other end. The electric brake is spring biased in the braking position with an electric release. An electromagnetic coil (not shown) inside electric brake 24 releases a spring actuation such that when no electric power is available the motor shaft is locked in position. Thus, a passenger leaning on a door will not force it open. Electric power is only required to open or close the doors and not to maintain the doors closed. Other fail safe braking systems can be used.

When the electric brake 24 is released, the electric motor 22 can turn the input shaft 26 either clockwise or counterclockwise. The motor may be brushless in one embodiment.

Mounted on the input shaft 26 is worm 28. A gear shaft 30 is mounted rotatable, and preferably, perpendicular to the input shaft 26. A worm gear 32 is fixed to the gear shaft 30 in a position to engage the worm 28. A second stage pinion 34 has a sliding connection on the gear shaft 30 enabling axial movement of the second stage pinion 34 between engaged and disengaged positions with the worm gear 32. Under normal conditions, the worm gear 32 is mounted to the lower portion of the gear shaft 30 and engages the second stage pinion 34 with pins 33 (see FIG. 2) or the like.

This arrangement allows for the emergency release of the input shaft 26 from the teeter 14 permitting manual opening of the door in an emergency. Alternatively, second stage pinion 34 may have one or more arm extensions received in one or more recesses in worm gear 32. With such arrangements, the electric door operator may be permitted to selectively engage the second stage pinion with respect to the worm gear, and thus, disengage the door operating mechanism entirely from the doors.

A second shaft 36 is mounted rotatable, preferably parallel, to the gear shaft 30. A second stage gear 38 is fixed to the second shaft 36 and arranged for engagement with the second stage pinion 34. A third stage pinion 40 is fixed to the second shaft 36. Said third stage pinion 40 is for directly or indirectly transferring torque to the output gear 48 fixed to the output shaft 16. In the particular embodiment illustrated in the drawings, there is a third shaft 42 having a third stage gear 44 fixed thereto for engagement with the third stage pinion 40 on the second shaft 36. A fourth stage pinion 46 is fixed to the third shaft 42 for engagement with a fourth stage or output gear 48 fixed to the output shaft 16. An advantage of this embodiment is that the gear ratios may be altered to vary the output torque available given the electric motor selected. A particular advantage of this embodiment is that the frictional forces between the second stage pinion 34 and the first stage gear 38 at the time of disengagement by axial movement of the first stage pinion can be minimized.

A drum cam shaft 50 is rotatable perpendicular to the housing 12. A drum cam 52 slides over the drum cam shaft. A pin 54 extends from the drum cam shaft 50 engaging a cam slot 56 in the drum cam. A lifting plate 58 is fixed to the drum cam 52 and extends to engage a circumferential slot 56 in the second stage pinion 34 to move the second stage pinion between engaged and disengaged positions. The cam slot 60 in the cam drum may have dwell portions 60A and 60B at each end thereof. In this case, the drum cam slot has a cam lifting portion having a face that extends circumferentially and axially and at the ends thereof has substantially circumferential dwell portions. As drum shaft 50 is rotated, the pin 54 travels from one dwell portion to the other either raising or lowering the drum cam 52 as the pin rides in the slot. The dwell portions 60A and 60B enhance engagement and reengagement of the first stage pinion and the worm gear by allowing some additional rotation without lifting or lowering the drum cam. In the illustrated embodiment, ball bearing 62 is press fit on the drum cam shaft 50 and abuts the housing 12 to axially constrain the drum cam shaft. Alternatively, a slot and retainer (not shown) and/or snap ring may be positioned on the drum cam shaft with a bearing or bushing to restrain axial movement of the drum cam shaft.

Referring again to FIG. 1, a disengagement lever 64 and engagement/disengagement cam 66 are fixed to the drum cam shaft. A pin 68 extends from the disengagement lever 64. A cable sheath bracket 70 is provided for fixing the sheath 72 of a release cable 74 to the housing 12. The release cable is fixed to a slotted end piece 76. The aperture 78 in the slotted end piece receives the pin 68 extending from the disengagement lever 64. A return spring 80 urges the slotted end piece 76 away from the cable sheath bracket 70.

When the release cable 74 is pulled, the drum cam shaft 50 rotates the pin 54 extending from the drum cam shaft 50 and the drum cam 52 moves to lift the lifting plate 58 and second stage pinion 34 to the disengaged position.

The engagement/disengagement cam 66 has spaced engagement cam surface portions 66A and disengagement cam surface portions 66B. An electrically operated actuator, for example, a solenoid 82 is fixed to the housing 12 for pulling a spring biased stop 84 away from the disengagement lever such that when the release cable is pulled, the slotted end piece 76 rotates the disengagement lever 64 and the rotation of the disengagement lever rotates the engagement/disengagement cam allowing the spring biased stop 84 to enter the disengagement cam surface portion preventing return of the first stage pinion to the engaged position until the solenoid is activated. Typically, actuation of the solenoid is only controlled by the vehicle operator.

Once the cable is released but before the disengagement lever 64 is rotated out of the emergency disengaged state, the cable may be spring biased by return spring 80 to return to the pre-emergency position urging the slotted end piece 76 to the opposite end of the aperture 78 (slot). Although the spring 80 may urge rotation of the engagement lever to the engaged position, the spring biased stop 84 in contact with the disengagement cam surface portion 66B prevents such rotation. Accordingly, the aperture in the slotted end piece 76 allows the cable to move back to its pre-emergency position but the worm gear 32 and second stage pinion 34 remain decoupled. The aperture (slot) 78 further allows a secondary drive to actuate the emergency release.

In one embodiment for transit bus doors, the decoupling of the electric door operator would allow the transit doors to freely rotate. Accordingly, in the emergency release state, the current design minimizes back-drive force by decoupling the spur gears in from the worm gear.

In order to return the transit doors to an operational state, the solenoid 82 is used to retract the stop 84 to allow the disengagement lever 64 to rotate back to the operational position. Such rotation of the lever is accomplished by a torsion spring 86 around the drum cam shaft urging the drum cam into the engagement position thus moving the second stage pinion into engagement with the worm gear. Thus second stage pinion 34 may be reengaged with the worm gear 32 once rotated into a position for engagement. This positioning may be accomplished by dithering of the motor 22.

According to a preferred embodiment, sensors are provided to detect the door open and/or closed positions of the teeter 14 and to detect when the worm gear 32 and second stage pinion 34 have been reengaged. As seen in FIG. 1, a target tab 88 rotates with the output shaft between sensors (for example, magnetic or optical sensors) 90, 92 enabling detection of the open and closed positions of the teeter 14 (and consequently the transit doors). Also as seen in FIG. 1, a target tab 94 rotates with the drum cam shaft 50 and is aligned with sensor 96 when the disengagement lever is in the engaged position. This is useful in order to command the discontinuance of motor dithering used to urge reengagement of the worm gear and the second stage pinion. The sensors could be located at various other positions and could be replaced with limit switches.

LIST OF REFERENCE NUMERALS

12 structure
14 teeter
15 drive arm
16 output shaft
18 journal
20 journal
22 motor
24 electro/mechanical brake
26 input shaft
28 first stage pinion (worm)
30 gear shaft
32 first stage gear (worm gear)
33 pin
34 second stage pinion
36 second shaft
38 second stage gear
40 third stage pinion
42 third shaft
44 third stage gear
46 fourth stage pinion
48 fourth stage gear
50 drum cam shaft
52 drum cam
54 pin
56 slot
58 lifting plate
60 cam slot
60A dwell portion
60B dwell portion
62 ball bearing
64 disengagement lever
66 engagement disengagement cam
66A engagement cam surface
66B disengagement cam surface
68 pin
70 bracket
72 sheath
74 cable
76 slotted end piece
78 aperture (slot)
80 return spring
82 solenoid
84 stop
86 torsion spring
88 target tab
90 sensor
92 sensor
94 target tab
96 sensor

The invention claimed is:

1. An electric door operator for opening and closing one or a spaced pair of transit vehicle passenger doors comprising:

a structure for being mounted adjacent an opening for the doors;

a rotatable input shaft mounted relative to the structure, an electric motor secured to the input shaft for driving the input shaft, a first stage pinion positioned on the input shaft, and an electric brake mounted to the input shaft;

an output shaft rotatable relative to the structure having a teeter mounted thereon with bearings at at least one end thereof for engagement with drive bars for opening and closing the doors, a gear fixed to the output shaft;

a gear shaft rotatable relative to the structure, a first stage gear fixed to the gear shaft in a position to engage the first stage pinion, a second stage pinion with a sliding connection to the gear shaft enabling axial movement of the second stage pinion between engaged and disengaged positions;

a second shaft rotatable relative to the structure, a second stage gear fixed to the second shaft and arranged for engagement with the second stage pinion, a third stage pinion fixed to the second shaft, said third stage pinion directly or indirectly transferring torque to the gear fixed to the output shaft;

a drum cam shaft rotatable relative to the structure, a drum cam rotatably and axially movable relative to the drum cam shaft, a pin extending from the drum cam shaft engaging a cam slot in the drum cam, a lifting plate fixed to the drum cam and extending to engage a slot in the second stage pinion to move the second stage pinion between engaged and disengaged positions;

a disengagement lever and engagement and disengagement cam fixed to the drum cam shaft, a pin extending from the disengagement lever; and a mechanical release fixed to a slotted end piece, the aperture in the slotted end piece receiving the pin extending from the disengagement lever, such that when the mechanical release is actuated, the drum cam shaft rotates the pin extending from the cam shaft and the drum cam moves to lift the lifting plate and second stage pinion to the disengaged position.

2. An electric door operator for opening and closing one or a spaced pair of transit vehicle passenger doors comprising:

a housing with a base plate for being mounted over an opening for the doors;

a rotatable input shaft mounted in the housing, an electric motor secured to the input shaft for driving the input shaft, a worm centrally positioned on the input shaft, and an electric brake mounted to the input shaft at an end opposite of the electric motor;

an output shaft rotatable perpendicular to the input shaft having a teeter mounted thereon below the base plate with bearings at opposite ends thereof for engagement with drive bars for opening and closing the doors, a gear fixed to the output shaft;

a worm gear shaft rotatable parallel to the output shaft, a worm gear fixed to the worm gear shaft in a position to engage the worm, a second stage pinion with a sliding connection to the worm gear shaft enabling axial movement of the second stage pinion between engaged and disengaged positions;

a second shaft rotatable parallel to the output shaft, a second stage gear fixed to the second shaft and arranged for engagement with the second stage pinion, a third stage pinion fixed to the second shaft, said third stage pinion directly or indirectly transferring torque to the gear fixed to the output shaft;

a drum cam shaft rotatable parallel to the output shaft, a drum cam rotatably and axially movable relative to the drum cam shaft, a pin extending from the drum cam shaft engaging a cam slot in the drum cam, a lifting plate fixed to the drum cam and extending to engage a slot in the second stage pinion to move the second stage pinion between engaged and disengaged positions;

a disengagement lever and engagement and disengagement cam fixed to the drum cam shaft, a pin extending from the disengagement lever; and a cable sheath bracket for fixing the sheath of a release cable to the base plate, a release cable fixed to a slotted end piece, the aperture in the slotted end piece receiving the pin extending from the disengagement lever, a return spring urging the slotted end piece away from the cable sheath bracket, such that when the release cable is pulled, the drum cam shaft rotates the pin extending from the drum shaft and the drum cam moves to lift the lifting plate and second stage pinion to the disengaged position.

3. The electric door operator for opening and closing one or a spaced pair of transit vehicle passenger doors according to claim 2 in which the disengagement lever has an engagement and disengagement cam, the engagement and disengagement cam having spaced engagement cam surface portions and disengagement cam surface portions, an electrically operated actuator fixed to the structure for pulling a spring biased stop away from the disengagement lever, such that when the release cable is pulled, the disengagement lever is rotated and the rotation of the disengagement lever rotates the engagement and disengagement cam allowing the spring biased stop to enter the disengagement cam surface portion preventing return of the second stage pinion to the engaged position until the electrically operated actuator is activated.

4. The electric door operator for opening and closing one or a spaced pair of transit vehicle passenger doors according to claim 1 or 2 in which the drum cam slot has a cam lifting portion having a face that extends circumferentially and axially and at the ends thereof has substantially circumferential portions.

5. The electric door operator for opening and closing one or a spaced pair of transit vehicle passenger doors according to claim 1 or 2 wherein at least one target is attached to the output shaft enabling the electronic sensing of the open or closed positions of the teeter.

6. The electric door operator for opening and closing one or a spaced pair of transit vehicle passenger doors according to claim 1 or 2 wherein a target is attached to the engagement and disengagement cam enabling electronic sensing of the cam in the engaged or disengaged position.

7. The electric door operator for opening and closing a spaced pair of transit vehicle passenger doors according to claim 1 or 2 in which one or more intermediate gear stages are positioned between the second stage pinion and the gear fixed to the output shaft for transferring torque.

8. The electric door operator for opening and closing a spaced pair of transit vehicle passenger doors according to claim 1 or 2 in which a secondary actuator device may be connected to actuate an emergency release.

9. The electric door operator for opening and closing a spaced pair of transit vehicle passenger doors according to claim 1 or 2 in which the electric brake is spring applied and electrically released.

* * * * *